United States Patent [19]

Batlas

[11] Patent Number: 4,489,857

[45] Date of Patent: Dec. 25, 1984

[54] LIQUID DISPENSER

[75] Inventor: George X. Batlas, Astoria, N.Y.

[73] Assignee: Bobrick Washroom Equipment, Inc., North Hollywood, Calif.

[21] Appl. No.: 360,403

[22] Filed: Mar. 22, 1982

[51] Int. Cl.[3] ..... B67D 5/42

[52] U.S. Cl. ..... 222/179; 222/185; 222/207; 222/214; 222/318; 222/325; 222/282; 222/334; 222/385

[58] Field of Search ..... 222/179, 181, 183, 185, 222/207, 209, 214, 318, 325, 334, 377, 385, 282

[56] References Cited

U.S. PATENT DOCUMENTS

| | | | |
|---|---|---|---|
| 2,413,136 | 12/1946 | Burger . | |
| 2,554,570 | 5/1951 | Harvey . | |
| 2,619,974 | 12/1951 | Daley et al. . | |
| 2,665,825 | 1/1954 | Poitras et al. | 222/179 X |
| 2,853,211 | 9/1958 | Chase | 222/385 X |
| 2,978,149 | 4/1961 | Rosen | 222/318 |
| 3,246,807 | 4/1966 | Micallef . | |
| 3,581,957 | 1/1969 | McCray . | |
| 3,892,339 | 7/1975 | Idler | 222/318 |
| 3,897,890 | 8/1975 | Jente | 222/179 |
| 3,952,924 | 4/1976 | Benson | 222/209 X |
| 4,018,363 | 4/1977 | Cassia . | |
| 4,036,406 | 7/1977 | Jesperson et al. . | |
| 4,130,224 | 10/1976 | Norman et al. . | |
| 4,149,573 | 4/1979 | Cassia . | |

FOREIGN PATENT DOCUMENTS

| | | | |
|---|---|---|---|
| 91141 | 5/1957 | Denmark | 222/214 |

*Primary Examiner*—Charles A. Marmor
*Attorney, Agent, or Firm*—Lyon & Lyon

[57] ABSTRACT

An easily operable liquid dispenser has a tamper-proof lid, a pressuring system that allows the dispenser to be operated either by a foot pump or by hand, and a control system that allows the amount of liquid dispensed by the dispenser to be varied.

15 Claims, 4 Drawing Figures

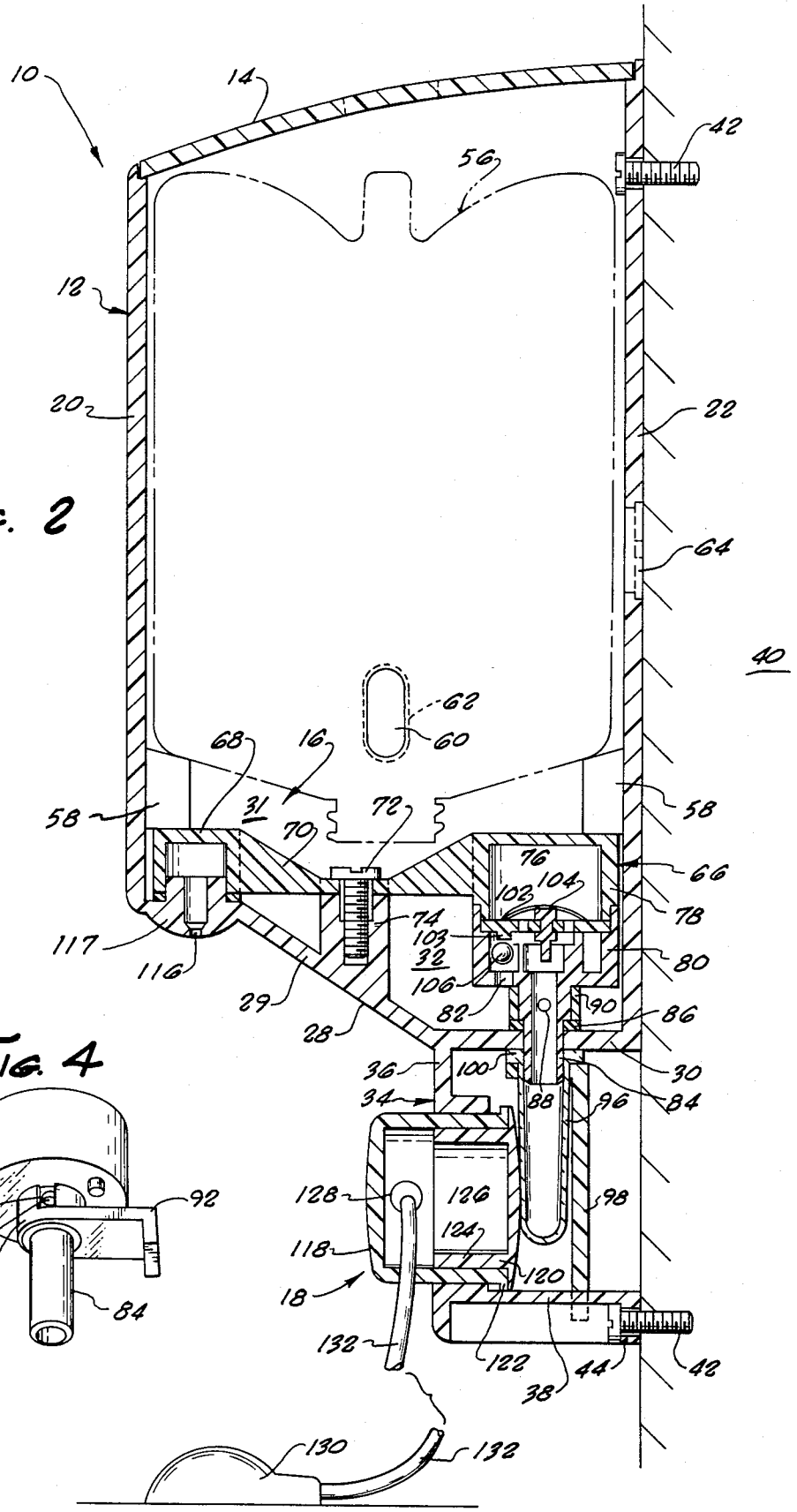
FIG. 2
FIG. 4
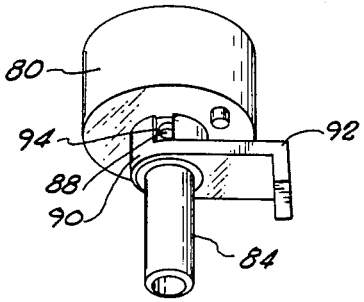

LIQUID DISPENSER

BACKGROUND

The present invention relates to the dispensers for liquids and particularly dispensers for viscous liquids such as liquid soap.

Dispensers for liquids such as soap are known. Such dispensers are described in U.S. Pat. Nos. 3,581,957; 4,018,363; 4,130,224; and 4,149,573. Prior art dispensers commonly have one or more disadvantages. For example, some dispensers are operatable only by hand, and cannot be operated remotely such as by a foot pump. Other dispensers can dispense only a set amount of soap, the amount of soap being dispensed not being variable. Further, many soap dispensers are not tamper-proof. In this day of increasing vandalism, it is desirable that it be extremely difficult for a vandal to be able to reach the working mechanism inside of a soap dispenser. Further, many soap dispensers require a large amount of force for their operation, an amount of force which often cannot be generated by children, the arthritic, and the handicapped.

Thus, there is a need for a liquid dispenser which can be operated remotely, is tamper-proof, can dispense a variable amount of liquid, and is easily operable.

SUMMARY

The present invention provides a dispenser having these features.

A liquid dispenser according to the present invention comprises a housing providing a liquid reservoir and a dispensing chamber in the housing. The dispensing chamber has an inlet for receiving liquid from the reservoir and a dispensing outlet for dispensing liquid. The dispensing chamber can be provided with a bypass outlet through which liquid can pass when the contents of the dispensing chamber are pressurized. The dispensing chamber also includes means for varying the cross-section of the bypass outlet to vary the amount of liquid dispensed through the dispensing outlet. Thus, the amount of liquid dispensed when the dispensing chamber is pressurized can be regulated.

Both the liquid inlet and outlet can have check valves, such as a ball check valve, or preferably an umbrella check valve for the outlet to minimize the force required to dispense liquid.

Pressurization of the dispensing chamber is provided by a resilient, flexible pump that is in communication with the dispensing chamber. The pump is pressurized by a piston, and a button is provided for pressing against the piston. The button and piston cooperate to form an enclosed push chamber. There is a fluid inlet into the push chamber and means for pressuring the push chamber through the fluid inlet, thereby causing the piston to be pressed against the pump without pushing the button. Thus, liquid can be dispensed either by pushing the button by hand, or by remote pressuring means, such as a foot pump.

The button can be cup-shaped and the piston can slide reciprocatingly within the button, where the piston is in nearly tight engagement with the inside wall of the button.

The housing has vertical walls and means for mounting the housing on a mounting surface, as well as a liftable cover. To render the dispenser tamper-proof, the edges of the cover preferably are completely enclosed by the walls of the housing, either alone, or in cooperation with the mounting surface. To obtain access to the inside of the dispenser, the cover is liftable and pivotable relative to the housing. This can be accomplished by elongated connecting means secured to the cover, the connecting means being pivotably and liftably retained in a chamber on a side wall of the housing.

Thus, the present invention provides a liquid dispenser that is substantially tamper-proof, can dispense a variable amount of liquid, can be operated remotely, and requires a low amount of force for dispensing liquids.

DRAWINGS

These and other features, aspects, and advantages of the present invention will become better understood with reference to the following description, appended claims, and accompanying drawings where:

FIG. 2 shows in vertical section the dispenser of FIG. 1 taken on line 2—2 of FIG. 1;

FIG. 4 shows in perspective means used for varying the volume of liquid dispensed by the dispenser of FIG. 1.

DESCRIPTION

The present invention will be described with regard to a dispenser for dispensing liquid soap. However, it will be appreciated that the dispenser of the present invention is useful for dispensing all types of liquids, and particularly viscous liquids, not only including soaps, but also viscous liquids such as oils, syrups, and the like.

Figure 1:
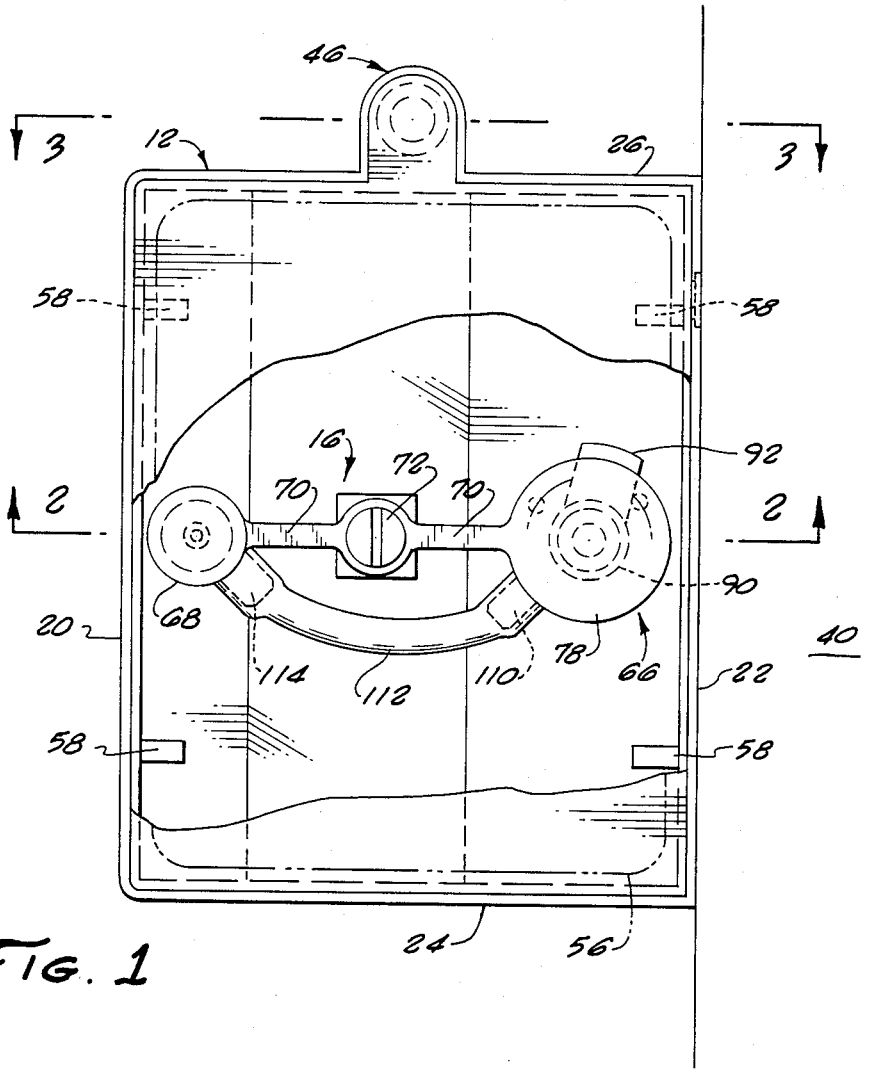
FIG. 1 is a top plan view of a dispenser according to present invention having a disposable container therein, with the cover removed and the disposable container partially broken away to show the working mechanism of the dispenser.

With reference to FIGS. 1 and 2, a liquid dispenser 10 according to the present invention comprises (a) a container or housing 12 having a top lid 14, (b) a dispensing mechanism 16, and (c) a pushing mechanism 18.

The container 12 is open at the top, covered by the lid 14. The container 12 can be round or oval, or as shown in the Drawings, can have four vertical walls, a front wall 20, a back wall 22, and opposing side walls 24 and 26, as well as a bottom wall 28 having a portion 29 that slopes downwardly from the front wall toward the back wall for about $\frac{2}{3}$ of its length and a portion 30 that extends horizontally for the remaining $\frac{1}{3}$. The inside of the container serves as a liquid reservoir 31. The Figures show the dispenser 10 without liquid therein. The bottom portion of the container serves as a dispensing section 32 in which the bulk of the dispensing mechanism 16 is located. Depending from the horizontal section 30 of the bottom wall 28 is a sub-housing 34 that supports the pushing mechanism 18. This sub-housing includes a vertical front wall 36 and a bottom wall 38. Its top is defined by the horizontal section 30 of the bottom wall 28 of the container 12.

In use, the liquid dispenser is mounted against a mounting surface such as a wall 40 by mounting screws 42, including a mounting screw extending through the upper portion of the back wall 22 of the container 12 and a mounting screw extending through a vertical flange 44 extending downwardly from the back portion of the bottom 38 of the sub-housing 34.

Figure 3:
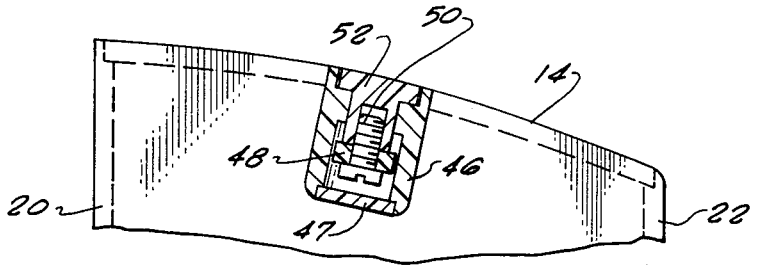
FIG. 3 shows in vertical section means for connecting the cover to the housing of the dispenser of FIG. 1 taken on line 3—3 of FIG. 1.

As shown in FIGS. 2 and 3, the edges of the cover 14 are completely enclosed by the walls of the container 12. Further, there are no projections on the top surface of the cover 14. Therefore, the cover cannot be removed from the container 12 without using a special device such as a suction cup. This renders the liquid dispenser 10 substantially tamper-proof.

In an alternate version of the invention, the edges of the lid 14 can be completely enclosed by the combination of the walls of the container 12 and the mounting surface 40.

The cover 14 is liftably and pivotably secured to the container 12. With reference to FIGS. 1 and 3, this is accomplished with a retaining chamber 46 projecting from the top portion of one of the container side walls, such as side wall 26. The retaining chamber has a hole in its bottom covered by a cap 47. A bushing 48 is retained within the retaining chamber 46. The bushing 48 is free to slide up and down and rotate within the chamber. Elongated connecting means such as an upside down screw 50 is threaded through the bushing 48 and extends into a depending connecting leg 52 of the lid 14. With the cap 47 in position, the bushing 48 cannot be removed from the retaining chamber 46. The lid 14, because it is connected to the bushing 48 by the screw 50, is permanently affixed to the container 12. However, the lid 14 can be lifted upwardly relative to the container 12 and can be rotated relative to the container 12 due to the free movement of the bushing 48 within the retaining chamber 46. When the lid is swung open, complete and easy access to the inside of the container is available for placement of a disposable container or for pouring a liquid to be dispensed.

The dispenser 10 can be used with a free flowing liquid and with liquid provided in a disposable container, such as the disposable container 56. The disposable container 56 is supported on ribs 58 projecting inwardly from the bottom portions of the front 20 and back 22 walls of the container 12.

A side wall of the container 12 can have a view port 60 for determining the level of liquid in the dispenser 10. A corresponding viewport 62 can be provided in a side wall of the disposable container 56.

An air vent 64 can be provided in one of the walls of the container, such as the back wall 22 as shown in FIG. 2. When using a free flowing liquid, it is necessary that the air vent be covered to prevent leakage.

The dispensing mechanism 16 comprises a dispensing housing 66 and an exit housing 68 connected by a rib 70. A fastener such as a screw 72 projects downwardly through a central portion of the rib 70 in to a lug 74 projecting upwardly from the sloping portion 29 of the bottom wall 28 of the container 12, thereby securing the dispensing mechanism to the container 12.

The inside of the dispensing housing 66 serves as a dispensing chamber 76. The dispensing housing is provided in two sections, an upper output housing 78 and a lower intake housing 80. The contents of the two housings 78 and 80 define the dispensing chamber 76.

The intake housing 80 includes an inlet or intake opening 82 in its bottom, and a depending nozzle 84 that extends downwardly through the horizontal section 30 of the bottom wall 28. The nozzle has a washer 86 adjacent to the bottom wall 28 to prevent leakage of liquid from the dispensing section 32 to the sub-housing 34 through the bottom wall 30. A bypass outlet 88 extends through the nozzle at a level above the bottom wall 30. A regulator 90 extends around the periphery of the nozzle at the bypass outlet 88. As shown in FIG. 4, the regulator 90 has a handle 92 and a slot 94. By rotating the regulator 90 around the nozzle 84, and varying the location of the slot 94, the amount of the area of the bypass outlet 88 that is opened can be regulated.

A tubular, flexible, resilient pump 96 that is closed at its bottom depends from the bottom of the nozzle 84. A back plate 98 is between the pump 96 and the mounting surface 40. The back plate 98 at its top has a horizontally extending retaining arm 100 that extends around the bottom of the nozzle and holds the pump 96 over the nozzle 84.

The output housing 78 and the intake housing 80 are separated from each other by an umbrella valve seat 102 that holds an umbrella valve 104. Alternatively, a spring loaded ball check valve could be used.

A ball check valve 106 is located at the intake outlet 82 and is held in location by the umbrella valve seat 102. The seat 102 has a pin 103 projecting downwardly to provide a space between the check valve 106 and the umbrella seat 102 so thick viscous liquids can flow into the output housing to press the check valve 106 down when dispensing liquid.

As shown in FIG. 1, the output housing 78 of the dispensing chamber 76 includes a dispensing outlet 110 that is connected by an output tube 112 to an inlet 114 of the exit housing 68. The exit housing 68 is located over a dispensing orifice 116 in a bulbous portion 117 of the bottom wall 28 of the housing. The bulbous portion 117 prevents dispensed material from running down the slope of bottom wall 28.

The pushing mechanism comprises a cup-shaped pushing button 118 and a cup-shaped piston 120, the button having an outwardly extending radial flange 122 adjacent to its open end. The button 118 extends out through the front wall of the sub-housing and is prevented from being removed therefrom by the radial flange 122 engaging the walls of the sub-housing 34.

The side wall 124 of the piston 120 extends inside the button 118. The side wall of the piston 124 makes an almost airtight engagement with the side wall of the button 118, thereby forming a relatively airtight push chamber 126. A hole 128 through the button provides access to the push chamber 126. The piston 120 can slide reciprocatingly within the button 118, the side wall of the button 118 forming the piston cylinder. In so sliding, the piston pushes against the pump, thereby compressing the pump 96 against the backplate 98.

After the dispenser 10 is primed by repeat compression of the pump 96, the dispenser can be used. In use of the liquid dispenser 10, liquid in the dispenser passes into the intake housing 80 through the intake inlet 82, the hydrostatic pressure of the liquid caused by gravity forcing the ball check valve 106 away from the intake inlet 82. The liquid fills the intake housing 80, as well as the pump 96.

To dispense liquid, pushing button 118 is pushed against the piston 120, thereby compressing the pump 96. Alternatively, the push chamber 126 can be pressurized, thereby causing the piston 120 to compress the pump 96 without the button 118 moving. The push chamber 126 can be pressurized by such means as a foot pump 130 connected to the push chamber by a tube 132 in communication with the hole 128 through the button. A suitable foot pump is described in U.S. Pat. No. 3,581,957 to McCray, which is incorporated herein by this reference. Repeated compressing of the pump 96 is required when the dispenser is first used to prime the dispenser.

Compression of the pump 96 forces the umbrella valve 104 upwardly, allowing liquid to pass through the umbrella valve washer 102 into the output housing 78. Also, a portion of the liquid can pass through the bypass outlet 88, depending upon the cross-sectional area of the outlet 88 that is left open by the regulator 90. Compression of the pump 96 causes the check ball 106 to close the intake opening 82, thereby preventing any liquid from passing out through the intake opening.

Liquid passes from the output housing 80, through the dispensing outlet 110, the output tube 112, and into the exit housing 68, from which it flows through the dispensing orifice 116.

The umbrella valve 104 prevents hydrostatic pressure from forcing liquid into the output housing 78.

A desirable feature of the present invention is fast cutoff of liquid being dispenses. Material cuts off as soon as the pressure or the pump 96 is released. As the pump 96 reverts to its non-compressed position the umbrella valve 104 immediately closes and atmospheric pressure through orifice 116 immediately stops liquid from being dispensed. Further, the suction caused by the pump reverting to its non-compressed position prevents drips from the orifice 116.

The materials used for the liquid dispenser can be any materials that are compatible with the liquid being used. For example, for liquid soap, the dispenser can be made of metal such as stainless steel, of plastic such as polyvinyl chloride, polycarbonate, ABS, nylon or acetal. A preferred umbrella valve 104 is obtainable from Vernay Laboratories, Inc. of Yellow Springs, Ohio under Catalog No. VA3557. This valve can resist a column of water of 7–8 inches without cracking. An advantage of using an umbrella valve 104 rather than a ball valve between the output 78 and intake housing 80 is that it requires very little pressure to displace an umbrella valve. The pump is made of a material having sufficient long-term resilience to return the button to its outward position. The pump can be made of an elastomeric material such as Buna-N, fluorosilicone, or Tygon TM.

After the button or foot pump is released, the piston is forced back to its position shown in FIG. 2 by the pump 96 due to the resilient nature of the pump.

The dispenser 10 has substantial advantages. For example, it is relatively tamper-proof. It can be operated by button, or remotely such as by a foot pump. It is advantageous to be able to use a foot pump in such places as hospitals where contamination of working personnel by pushing a button by hand is to be avoided. Because of the arrangement of the sliding piston, the pump, and the use of an umbrella valve, only a very small force in the order of about 3 pounds for liquid soap is required to dispense liquid. This small force makes the dispenser 10 particularly useful for children, arthritics, and the handicapped.

A further advantage of the dispenser 10 is that all of the dispensing mechanism, with the exception of the pump 96, can be pre-assembled prior to placing it in the container. This renders the dispenser 10 easy and inexpensive to manufacture.

A further advantage is that the dispenser can be used both with prepackaged liquids or free flowing liquids because the dispensing mechanism is self-contained and the housing can be leak-proof.

A further advantage is that substantially all of the liquid in a disposable container is emptied. Moreover, even after the disposable container is empty, a substantial amount of material remains within the dispenser, an amount that is normally sufficient until the next disposable container is in place.

Another advantage results from the sloping bottom wall 28. This provides maximum visibility for the push button 118.

A further advantage is that the amount of material dispensed is regulated.

A further advantage is that the button is pressed inwardly. This inward motion cannot cause the dispenser to become loosened from the wall as can happen with dispensers with levers that pull forward from the wall. Morever, the unit is capable of dispensing substantially all liquids, including water and very thick and viscous lotions.

Although the present invention has been described in considerable detail with reference to certain preferred versions thereof, other versions are possible. Therefore the spirit and scope of the appended claims should not necessarily be limited to the description of the preferred versions contained herein.

What is claimed is:

1. A liquid dispenser comprising:

(a) a housing providing a liquid reservoir;

(b) a dispensing chamber in the housing, the dispensing chamber having an inlet for receiving liquid from the reservoir and a dispensing outlet for dispensing liquid from the dispensing chamber;

(c) a resilient, flexible pump in communication with the dispensing chamber;

(d) a piston for pressing against the pump;

(e) a button for pressing against the piston, wherein the button and piston cooperate to form an enclosed push chamber; and (f) a fluid inlet into the push chamber for pressuring the push chamber to cause the piston to press against the pump without pushing the button.

2. The dispenser of claim 1 in which the means for pressuring comprises a foot pump.

3. The dispenser of claim 1 in which the button is cup-shaped and the piston slides reciprocatingly within the button, the piston being in a nearly air tight engagement with the inside wall of the button.

4. The dispenser of claim 1 in which the liquid inlet has a check valve for preventing liquid from passing out of the dispensing chamber through the inlet and the liquid outlet has a check valve for preventing liquid from passing into the dispensing chamber through the outlet.

5. The dispenser of claim 1 or 4 in which the dispensing outlet has an umbrella check valve.

6. The dispenser of claim 1 in which the dispensing chamber has a bypass outlet through which liquid can pass when the pump is pressed, and the dispenser includes means for varying the cross-section of the bypass outlet to vary the amount of liquid dispensed through the dispensing outlet.

7. The dispenser of claim 6 in which the bypass outlet is in fluid communication with the reservoir.

8. The dispenser of claim 1 in which the liquid inlet is within the reservoir so that the dispensing chamber is filled with liquid at least partly by gravity.

9. The dispenser of claim 1 in which the housing comprises side walls, means for mounting the housing on a mounting surface, and a liftable cover, the edges of the cover being completely enclosed when the dispenser is mounted on the mounting surface to prevent tampering.

10. The dispenser of claim 9 in which the edges of the cover are enclosed by the side walls of the housing.

11. The dispenser of claim 9 including means for connecting the cover to the housing so that the cover can be lifted up from the housing and can pivot relative to the housing.

12. The dispenser of claim 11 in which the connecting means is pivotably and liftably retained in a chamber on a side wall of the housing and is secured to the cover.

13. A liquid dispenser comprising:

(a) a housing providing a liquid reservoir, the housing having side walls, means for mounting the housing on a mounting surface, an elongated connector having one end section pivotably and liftably retained in a chamber on a side wall of the housing, the other end section of the connector being secured to the cover so that the cover can be lifted up from the housing and can pivot relative to the housing, wherein the edges of the cover are completely enclosed by the side walls of the housing when the dispenser is mounted thereon to prevent tampering;

(b) a dispensing chamber in the housing, the chamber having a liquid inlet for receiving liquid from the reservoir and a dispensing outlet for dispensing liquid, the dispensing outlet being provided with an umbrella check valve for preventing liquid from passing into the chamber through the outlet and the liquid inlet having a check valve for preventing liquid from passing out of the chamber through the inlet;

(c) a resilient, flexible pump in communication with the dispensing chamber;

(d) a cup-shaped button with a piston reciprocatingly slidable therein, the piston being in a nearly airtight engagement with the inside wall of the button, the piston being pressable against the pump and the button being pressable against the piston for pressing the piston against the pump, wherein the button and piston form an enclosed push chamber;

(e) a fluid inlet into the push chamber;

(f) means for pressuring the push chamber through the fluid inlet to cause the piston to press against the pump without pushing the button;

(g) a bypass outlet for the dispensing chamber, wherein liquid can pass through the bypass outlet when the pump is pressed, the bypass outlet being in fluid communication with the reservoir; and (h) means for varying the cross-section of the bypass outlet to vary the amount of liquid dispensed through the dispensing outlet, wherein the liquid inlet of the dispensing chamber is within the reservoir so that the dispensing chamber is filled with liquid at least partly by gravity.

14. A liquid dispenser comprising:

(a) a housing providing a liquid reservoir, the housing comprising (i) side walls and (ii) a liftable cover, the edges of the cover being completely enclosed by the side walls of the housing to prevent tampering;

(b) a dispensing chamber in the housing, the chamber having (i) an inlet for receiving liquid from the reservoir, (ii) a dispensing outlet for dispensing liquid from the dispensing chamber, (iii) a bypass outlet through which liquid can pass when the contents of the dispensing chamber are pressurized, and (iv) means for varying the cross-section of the bypass outlet to vary the amount of liquid dispensed through the dispensing outlet;

(c) a resilient, flexible pump in communication with the dispensing chamber;

(d) a piston for pressing against the pump;

(e) a button for pressing against the piston, wherein the button and piston cooperate to form an enclosed push chamber; and (f) a fluid inlet into the push chamber for pressuring the push chamber to cause the piston to press against the pump without pushing the button.

15. The dispenser of claim 1, 13, or 14 wherein the housing comprises a bottom wall and a sub-housing for the piston and button depending from the bottom wall, wherein at least a portion of the bottom wall slopes downwardly to make the button easily visible.

* * * * *